US006867748B2

(12) United States Patent
Hsu

(10) Patent No.: US 6,867,748 B2
(45) Date of Patent: Mar. 15, 2005

(54) MULTI-COMBINED MULTI-FREQUENCY ANTENNA

(75) Inventor: Cho-Kang Hsu, Pingdung (TW)

(73) Assignee: INPAQ Technology Co., Ltd., Hsinchu (TW)

( * ) Notice: Subject to any disclaimer, the term of this patent is extended or adjusted under 35 U.S.C. 154(b) by 0 days.

(21) Appl. No.: 10/458,310

(22) Filed: Jun. 11, 2003

(65) Prior Publication Data

US 2004/0252066 A1 Dec. 16, 2004

(51) Int. Cl.[7] ..... H01Q 1/36
(52) U.S. Cl. ..... 343/895; 343/702
(58) Field of Search ..... 343/702, 895

(56) References Cited

U.S. PATENT DOCUMENTS

| | | | | | |
|---|---|---|---|---|---|
| 4,868,576 | A | * | 9/1989 | Johnson, Jr. | 343/702 |
| 5,298,910 | A | * | 3/1994 | Takei et al. | 343/895 |
| 5,563,615 | A | * | 10/1996 | Tay et al. | 343/749 |
| 5,841,407 | A | * | 11/1998 | Birnbaum | 343/895 |
| 6,388,625 | B1 | * | 5/2002 | Fukushima et al. | 343/702 |
| 6,559,811 | B1 | * | 5/2003 | Pulimi et al. | 343/895 |
| 6,563,476 | B1 | * | 5/2003 | Sheng-Gen et al. | 343/895 |

* cited by examiner

*Primary Examiner*—Tho Phan
(74) *Attorney, Agent, or Firm*—Troxell Law Office, PLLC

(57) ABSTRACT

Disclosed herein is a multi-combined multi-frequency antenna, and in particular, to an antenna which has a helically wound conductor and a plate type or a linear type conductor, so as to form a multi-combined antenna which is operatable against various frequency bands.

5 Claims, 11 Drawing Sheets

MULTI-COMBINED MULTI-FREQUENCY ANTENNA

BACKGROUND OF THE INVENTION

1. Field of the Invention

The present invention relates to a multi-combined multi-frequency antenna, and in particular, to an antenna which has a helically wound conductor and a plate type or a linear type conductor, so as to form a multi-combined antenna which is operatable against various frequency bands.

2. Description of the Prior Art

As it is well known, an antenna plays an important role on the communication engineering. If it had not been for an antenna, transmission and reception of communication signals would have become impossible, and electronic technology would have lost its playground.

A well-known stub antenna emerged out of a cellular phone housing 100 is shown in FIG. 1. An essential part, an antenna body 200 is, as shown in FIG. 2, made of a helically wound wire conductor, which is further sectioned into two or more than two sections L1, L2, . . . . The pitches P1, P2 . . . of two successive L1, L2 helically wound wire conductors make the antenna applicable for multi-frequency band communication.

A stub 300 is fitted into the hollow fuselage of the antenna body 200 therefore increasing the extra cost of the stub 300, moreover, the cascade connection of the helically wound wire conductors L1, L2 . . . results in increasing the height and the fabrication cost of the antenna.

In order to solve the above-described problems, the present inventor has carried out theoretical studies and simulating experiments, and based on these studies and researches, the present inventor has come to propose the present invention.

SUMMARY OF THE INVENTION

Accordingly, the main object of the present invention is to provide a multi-combined multi-frequency antenna whose main body is composed of two or more sections in which one of the two sections is enveloped by the other, and the inner one may also serve as a supporting stem of an antenna so as to shorten the length of antenna and reduce the fabrication cost of the antenna.

To achieve the aforesaid object, the antenna of the present invention comprises a helically wound antenna conductor and a plate type or a linear type antenna conductor, the former is formed with helically wound wires, while the latter is formed by printing an antenna conductor pattern on a plate substrate, or another helically wound wire conductor. The base part of the antenna conductor pattern is formed with several protuberances. The helically wound antenna conductor and the plate type antenna conductor are connected together by contacting their base parts with each other thereby forming a multi-frequency antenna consisting of two antenna sections.

When the antenna is formed with two sections of helically wound antenna conductors, the smaller one is enveloped by the larger one, its length then also can be greatly reduced.

Because the height of the antenna of present invention is greatly reduced, it then can greatly reduce the size of portable transmission apparatus and its manufacturing cost, this is also another object of present invention.

Furthermore, because the antenna body of the present invention can be constructed by two helical conductors to be enveloped together, and the two ends of helical antenna conductors are linearly extended. Consequently, it is easy to respectively change the length of the end of said helical antenna to make each of the helical antenna have a special relationship with a wave. Then achieve the function of multi-frequency. This is also another object of present invention.

BRIEF DESCRIPTION OF THE DRAWINGS

A more complete understanding of these and other features and advantages of the patent invention will become apparent from a careful consideration of the following detailed description of certain embodiments illustrated in the accompanying drawings, in which.

DETAILED DESCRIPTION OF THE PREFERRED EMBODIMENTS

Figure 1:
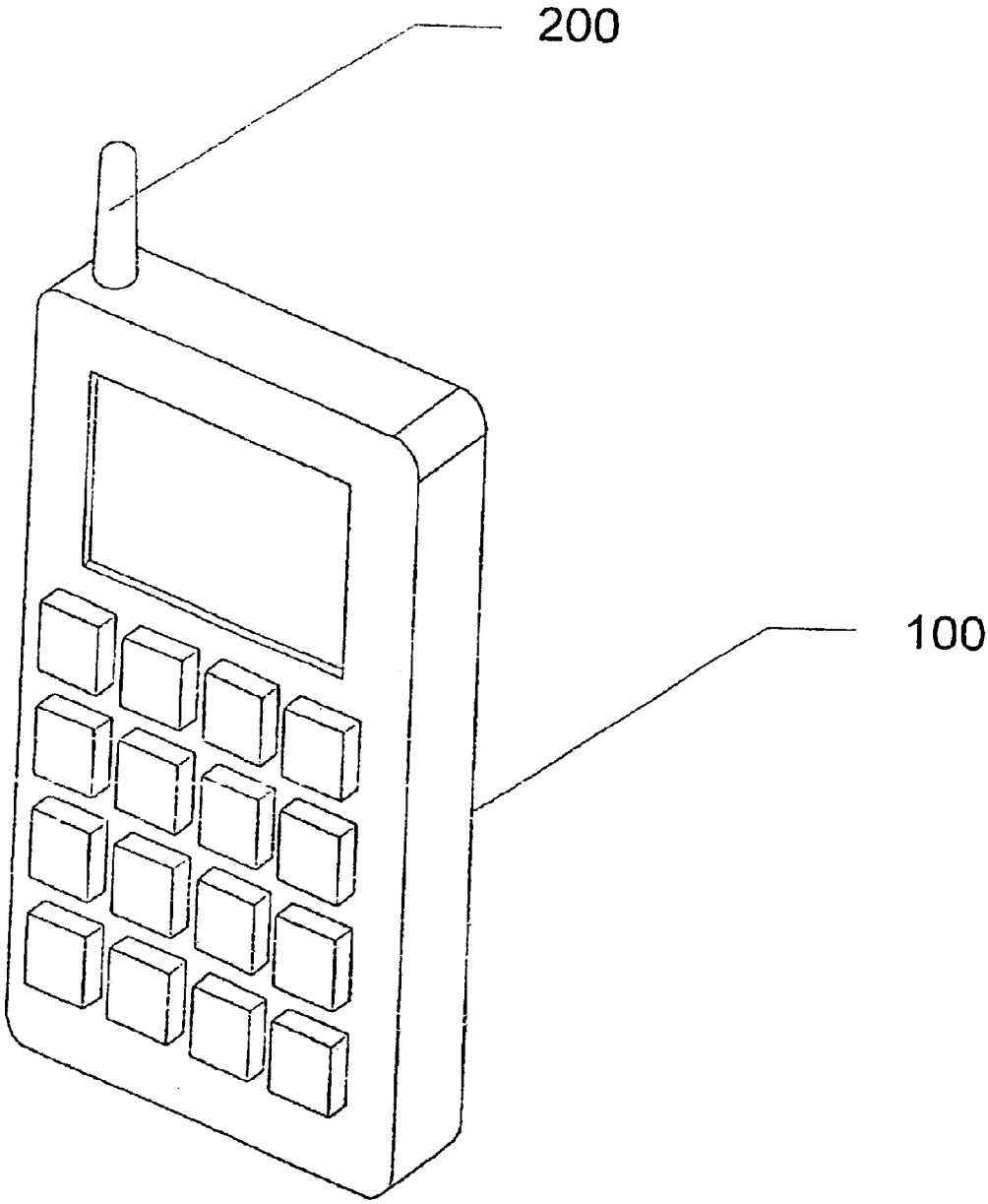
FIG. 1 (PRIOR ART)
FIG. 1 is a schematic view of a conventional cellular phone and its antenna.
Figure 2:
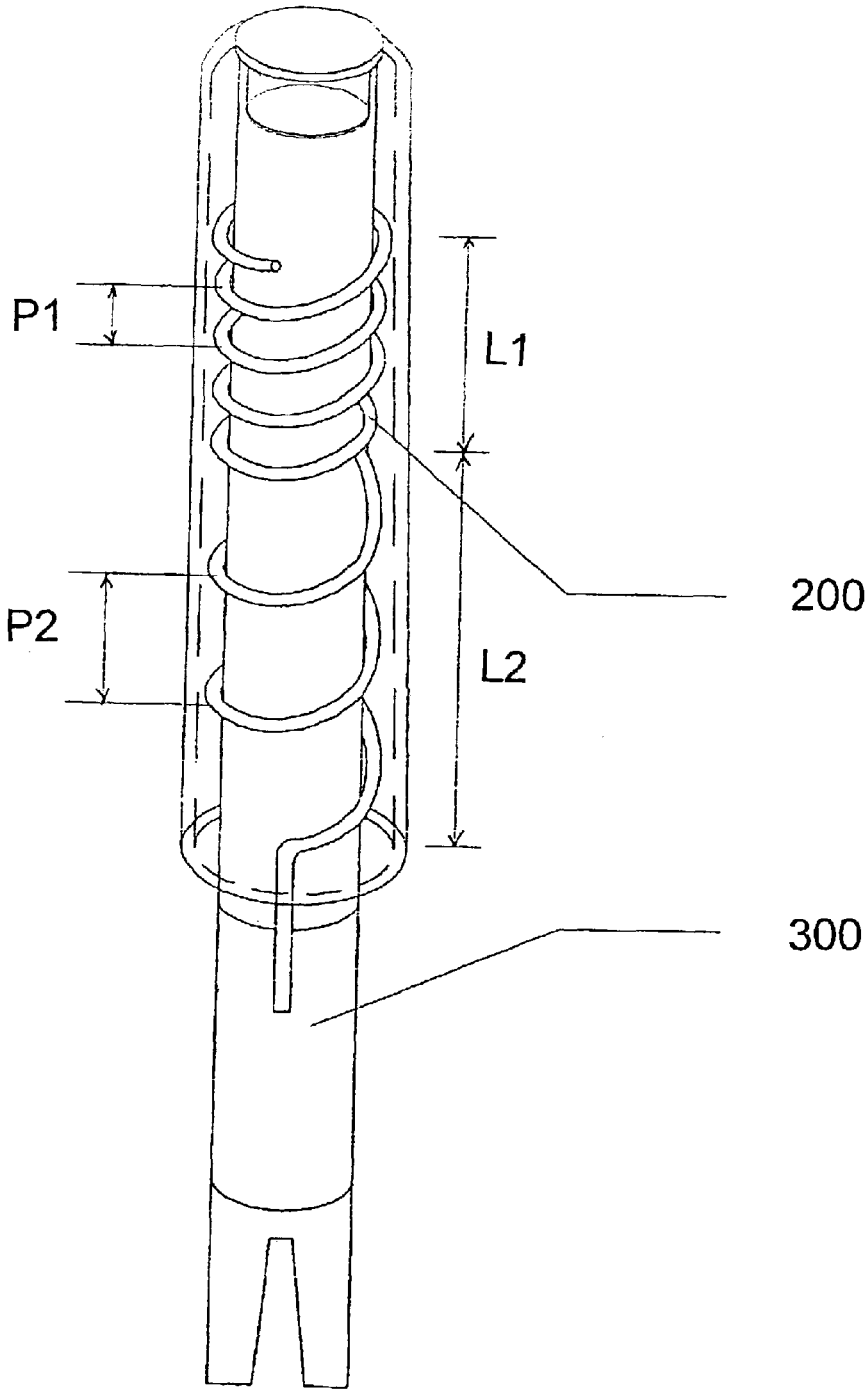
FIG. 2 (PRIOR ART)
FIG. 2 is a schematic view showing the antenna construction inside the housing of the cellular phone shown in FIG. 1.

FIGS. 1 and 2 are schematic views of a cellular phone with its affixed antenna whose structural characteristic has been illustrated and thus will not be repeated herein.

Figure 3:
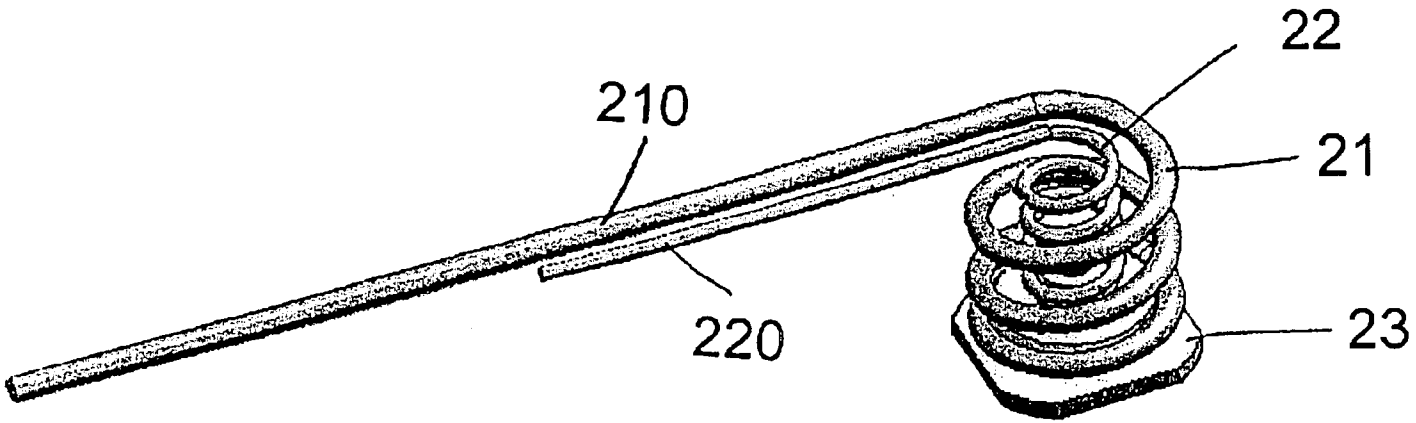
FIG. 3 is a schematic view of the multi-combined multi-frequency antenna according to the present invention.

FIG. 3 shows a schematic view of the antenna of the present invention. It is clearly seen that a preferred embodiment of the antenna of the present invention essentially comprises a plurality of helical antenna conductors 21, 22 and connecting seat 23 for antenna conductors.

Figure 4:
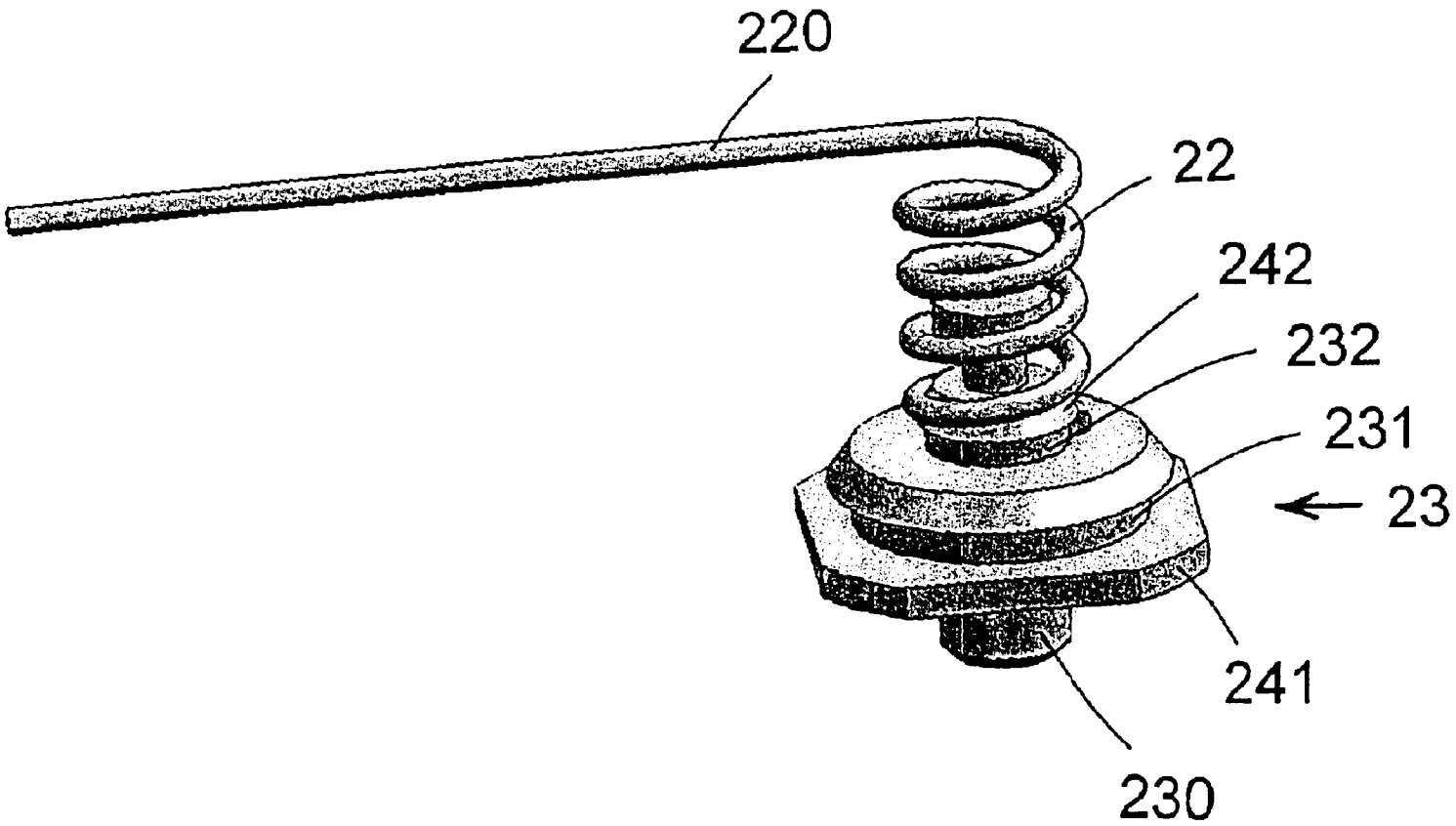
FIG. 4 is a schematic view of the helical antenna conductor in combination with the connection seat of the present invention.

The pitch distances and lengths of the helical antenna conductors 21, 22 are respectively in a defined relationship with a specific frequency band. As shown in FIG. 4, a preferred embodiment of connecting seat 23 for antenna conductors 21, 22 has a transmitting rod 230, on the transmitting rod 230, there are a plurality of transmitting plates 231, 232 to be separated by isolating plates 241, 243. The outer diameters of transmitting plates 231, 232 are respectively matched with the inner diameters of the bases of said helical antenna conductors 21, 22. Such that the helical antenna conductors 21, 22 can respectively envelop said separated transmitting plates 231, 232 and to be fixed onto them. The ends of helical antenna conductors 21, 22 are extension portions 210, 220 of linearly extended. The lengths of said extension portions 210, 220 can be changed by cutting out a segment of the extension portion 210 and 220. Then an antenna conductor 21/22 which has a defined relationship with a wavelength of specific frequency band is obtained. While the lengths of the antenna conductors are different, the antenna then can be operatable against various frequency bands.

Figure 5:
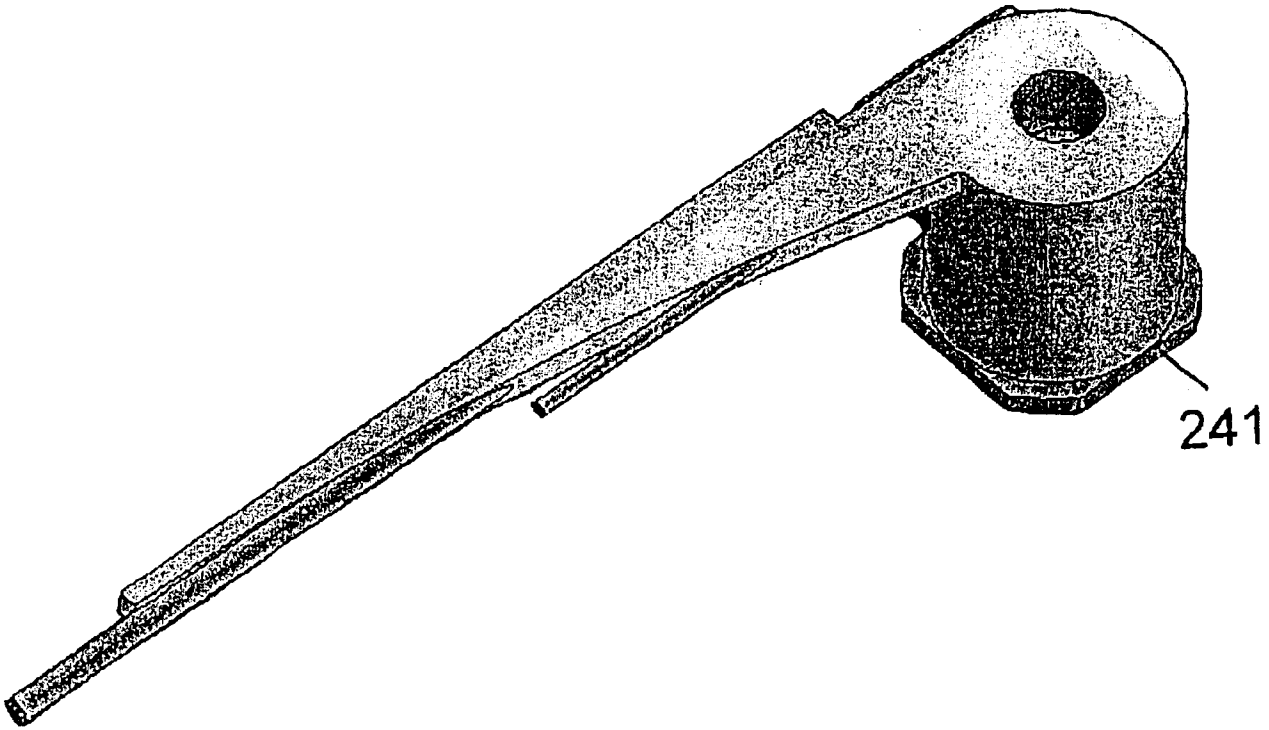
FIG. 5 is a schematic view of the antenna in an embodiment of the present invention.

After the body construction of the multi-combined multi-frequency antenna of present invention is obtained, as shown in FIG. 5, the antenna construction can be sealed by injecting gel or resin into a housing to form a product of antenna. The height of the antenna can be made smaller than 10 mm. Because it contains the portion of linear antenna conductor, its function of receiving signals can be maintained. And, because its height is greatly reduced, the dimensions of electronic commissioners still can be greatly reduced.

Figure 6:
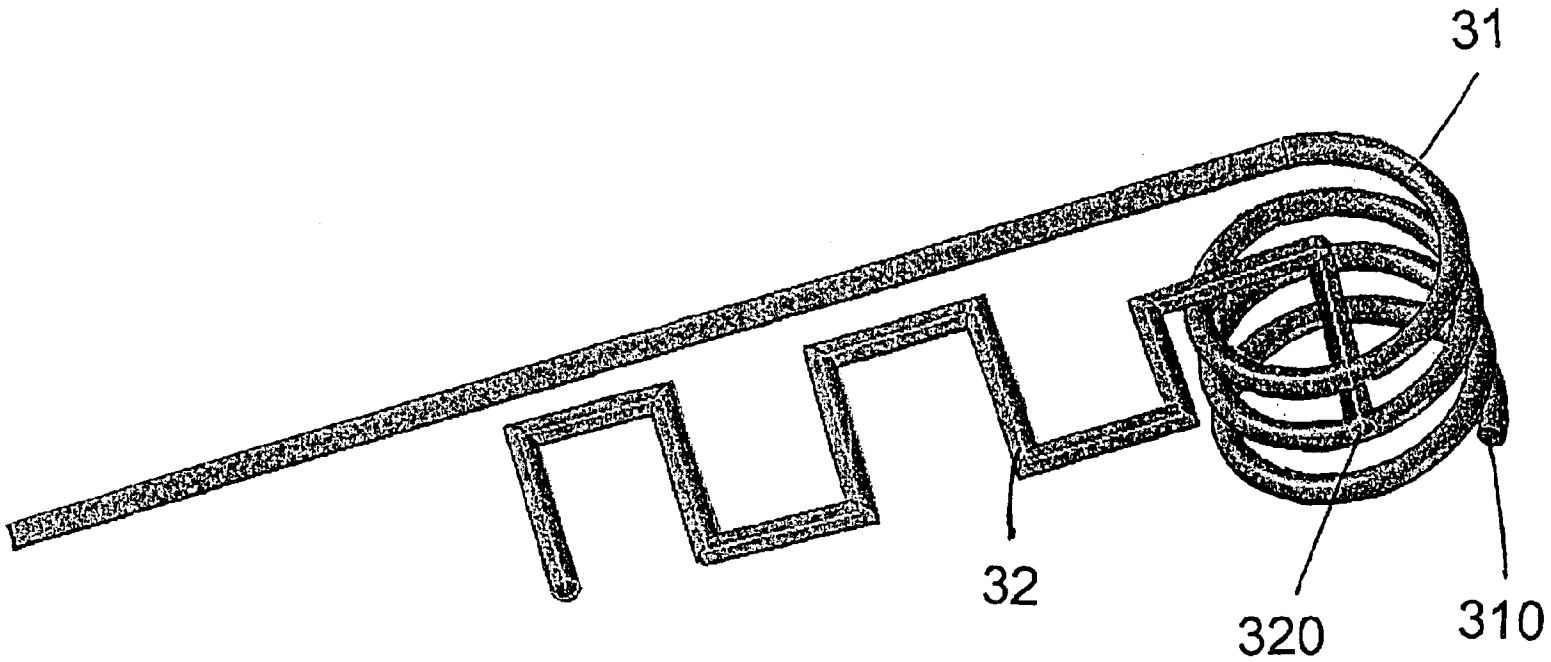
FIG. 6 is a schematic view of the antenna conductor showing another embodiment of the present invention.

As shown in FIG. 6, the antenna conductor of present invention can be constructed by a helical antenna conductor portion 31 and a perpendicular continuous linear conductor portion 32 extends from the central part of said helical antenna conductor 31. The bases 310, 320 of said helical antenna conductor portion 31 and perpendicular continuous linear conductor portion 32 are connected to signal output and input terminals of the electronic circuit of electronic transmitting apparatus. After experiment, such construction also shows the functions of said first embodiment of present invention.

Figure 7:
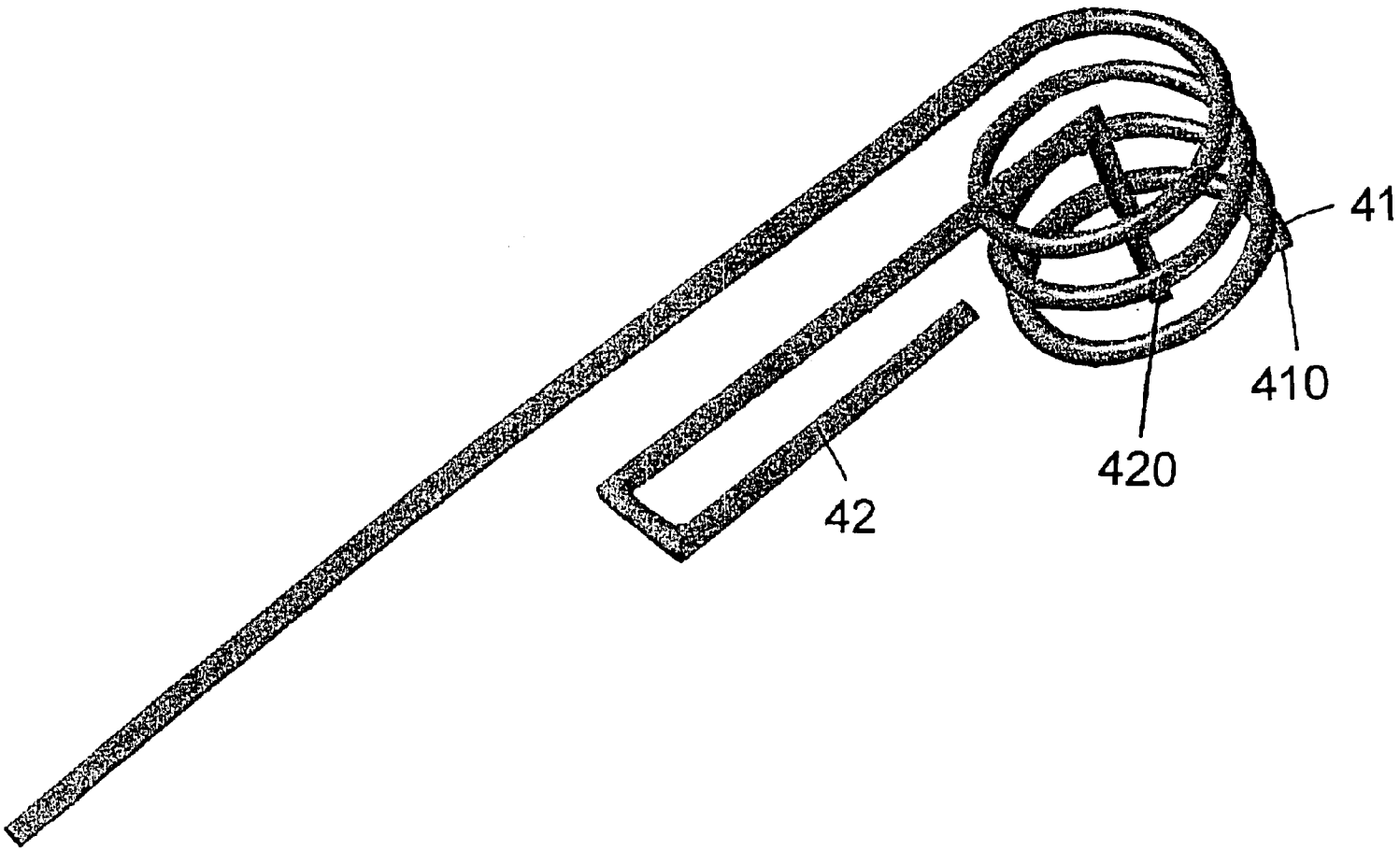
FIG. 7 is a schematic view showing one more embodiment of the antenna conductor of the present invention.

Again as shown in FIG. 7, the antenna conductor of present invention can be constructed by a helical antenna conductor portion 41 and a horizontal continuous linear conductor portion 42 extends from the central part of said helical antenna conductor 41. The bases 410, 420 of said helical antenna conductor portion 41 and perpendicular continuous linear conductor portion 42 are connected to signal output and input terminals of the electronic circuit of electronic transmitting apparatus. After experiment, such construction also shows the functions of said first embodiment of present invention.

Figure 8A:
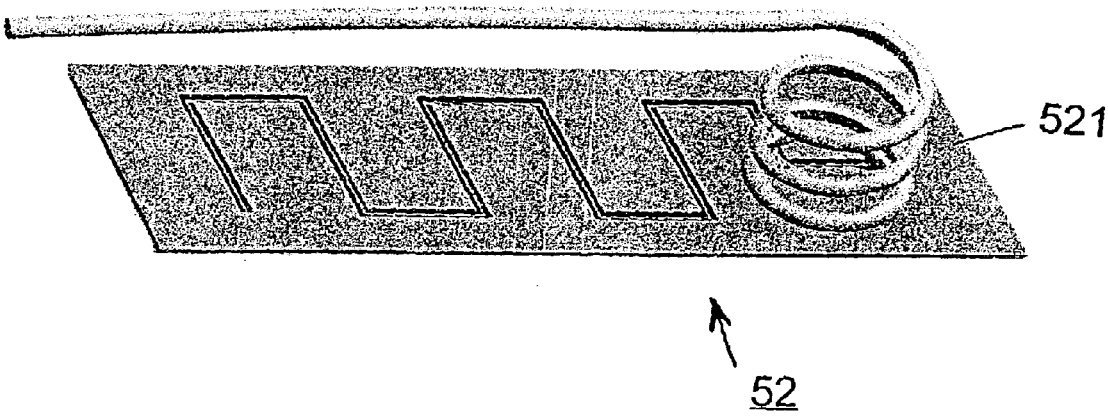
FIGS. 8A, 8B and 8C are two schematic views showing three more embodiments of the antenna conductor of the present invention.
Figure 8B:
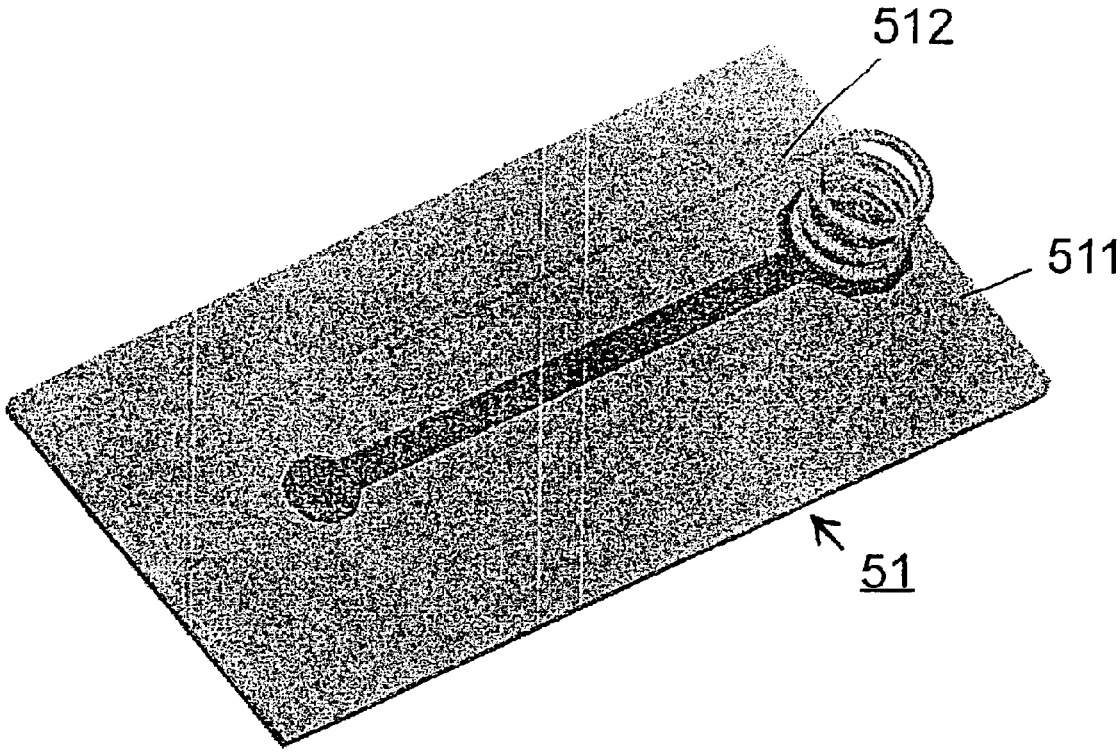
Figure 8C:
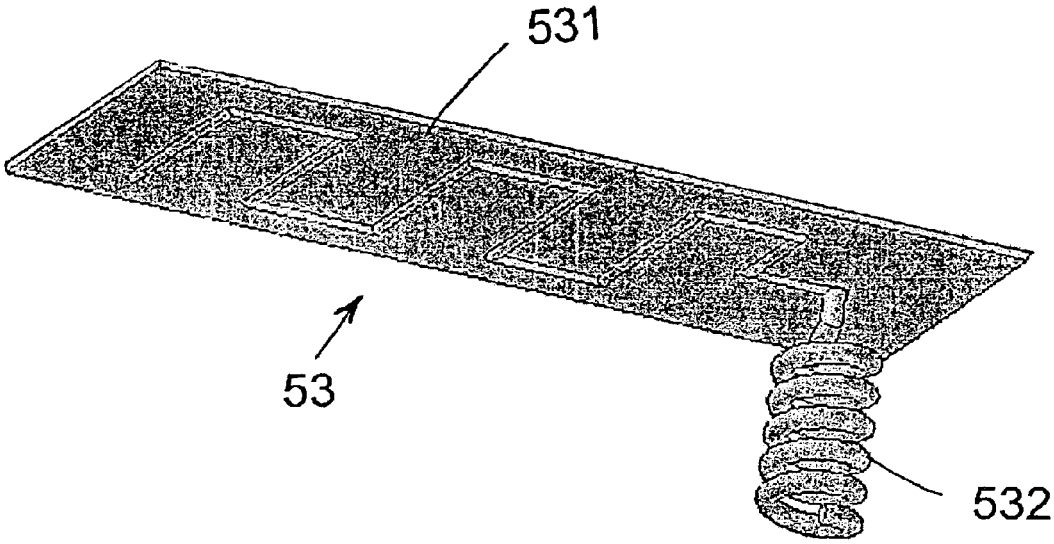
Figure 9:
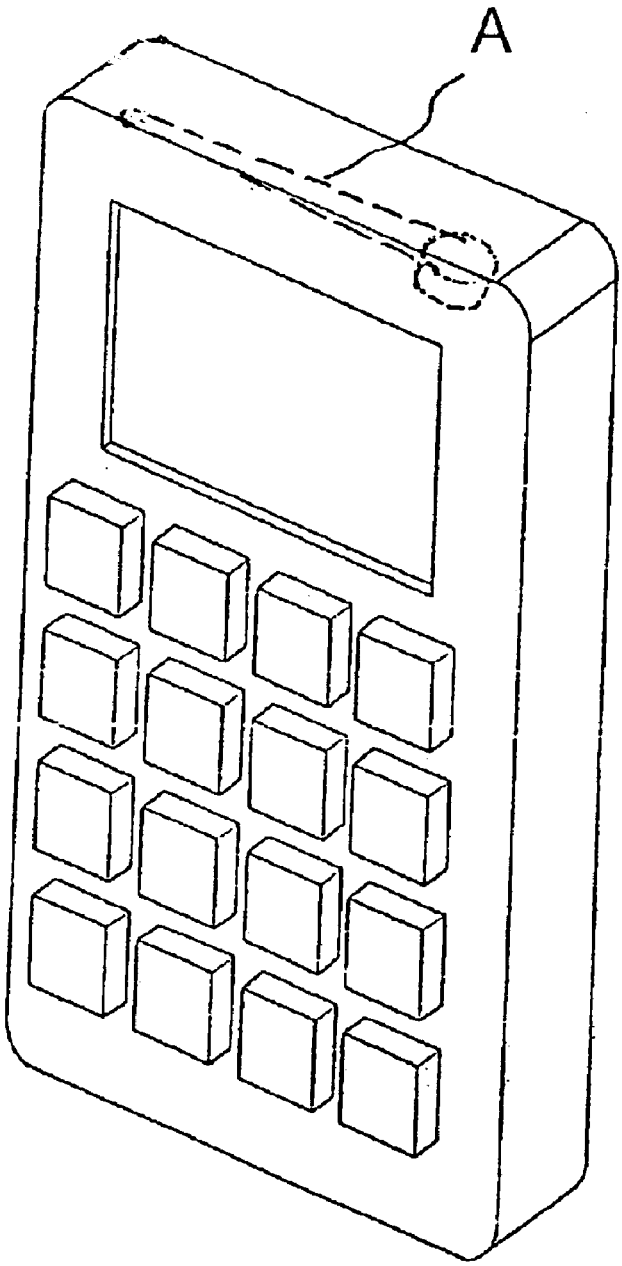
FIG. 9 is a schematic view showing the antenna of the present invention is accommodated in a housing of a cellular phone.

Further, as shown in FIGS. 8A, 8B, and 8C, the antenna body of present invention also can be constructed by a plurality of antenna conductor units 51, 52, 53. While each of the antenna conductor units 51, 52, 53 contains respectively a thin PCB 511/521/531 and helical antenna conductor portion 512/522/532. And, one base portion of said helical antenna conductor portion 512/522/532 is connected to the end of antenna conductor of said thin PCB 511/51/531. After experiment, such construction also shows the functions of said first embodiment of present invention.

Although the present invention has been described with a certain degree of particularity, the present disclosure has been made by way of example and changes in details of structure may be made without departing from the spirit thereof.

What is claimed is:

1. A multi-combined multi-frequency antenna comprising:

a plurality of helical antenna conductors wherein said helical antenna conductors are formed with helically wound wires, and the plurality of helical antenna conductors are enveloped together; and a connecting seat for the plurality of helical antenna conductors, which includes a transmitting rod having a plurality of transmitting plates separated by a plurality of plates, outer diameters of said transmitting plates are respectively matched with inner diameters of bases of said helical antenna conductors, such that said helical antenna conductors respectively envelop said transmitting plates and are fixed onto said transmitting rod.

2. The multi-combined multi-frequency antenna as claimed in claim 1, wherein each of said plurality of helical antenna conductors has a predetermined relationship with a wavelength of a specific frequency band, and an end is a linear antenna conductor.

3. The multi-combined multi-frequency antenna as claimed in claim 1, wherein each of said plurality of helical antenna conductors has a helical antenna conductor portion and a perpendicular continuous linear conductor portion.

4. The multi-combined multi-frequency antenna as claimed in claim 3, wherein said perpendicular continuous linear conductor portion is formed on a thin film.

5. The multi-combined multi-frequency antenna as claimed in claim 4, wherein said linear antenna conductor portion is a pattern formed by printing a layout of antenna on a substrate.

* * * * *